US010295925B2

(12) United States Patent
Yoshida

(10) Patent No.: US 10,295,925 B2
(45) Date of Patent: May 21, 2019

(54) IMAGE FORMING APPARATUS

(71) Applicant: KYOCERA Document Solutions Inc., Osaka-shi (JP)

(72) Inventor: Takeshi Yoshida, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/647,317

(22) Filed: Jul. 12, 2017

(65) Prior Publication Data

US 2018/0024457 A1 Jan. 25, 2018

(30) Foreign Application Priority Data

Jul. 19, 2016 (JP) ..... 2016-141673

(51) Int. Cl.

| | |
|---|---|
| ***G03G 15/02*** | (2006.01) |
| ***G03G 15/00*** | (2006.01) |
| ***G03G 15/23*** | (2006.01) |
| *G03G 15/04* | (2006.01) |

(52) U.S. Cl.

CPC ..... *G03G 15/0216* (2013.01); *G03G 15/23* (2013.01); *G03G 15/65* (2013.01); *G03G 15/657* (2013.01); *G03G 15/6529* (2013.01); *G03G 15/6558* (2013.01); *G03G 15/04* (2013.01); *G03G 15/5054* (2013.01)

(58) Field of Classification Search

CPC ..... G03G 15/0216
USPC ..... 399/16
See application file for complete search history.

(56) References Cited

U.S. PATENT DOCUMENTS 4,994,861 A * 2/1991 Brandon ..... G03G 15/6552 271/208
5,421,261 A * 6/1995 Stempien ..... B41J 29/17 101/423

(Continued)

FOREIGN PATENT DOCUMENTS

JP H06-250463 A 9/1994
JP H10-302993 A 11/1998

(Continued)

OTHER PUBLICATIONS

Japanese Office Action dated Feb. 18, 2019.

*Primary Examiner* — Anthony H Nguyen
(74) *Attorney, Agent, or Firm* — Gerald E. Hespos; Michael J. Porco; Matthew T. Hespos

(57) ABSTRACT

An image forming apparatus includes an image forming section, a conveyance guide and a static eliminator. The image forming section is configured to form the images on a sheet being conveyed along a first conveyance path. The conveyance guide is configured to define a second conveyance path that is designed to convey therealong the sheet being switched back thereto from the first conveyance path, the second conveyance path arranged at a position downstream of the image forming section in a conveyance direction of the sheet conveyed along the first conveyance path. The second conveyance path has an outlet area joined with the first conveyance path at a position upstream of the image forming section. The static eliminator is configured to eliminate static electricity from the sheet fed from the first conveyance path to the second conveyance path. The static eliminator is disposed in the outlet area.

11 Claims, 7 Drawing Sheets

(56) References Cited

U.S. PATENT DOCUMENTS

| | | | | | |
|---|---|---|---|---|---|
| 5,478,061 | A * | 12/1995 | Murakami | G03G 15/6538 | 270/58.08 |
| 5,611,253 | A * | 3/1997 | Saito | B26D 1/205 | 83/383 |
| 5,758,247 | A * | 5/1998 | Yanashima | G03G 15/164 | 399/315 |
| 7,680,449 | B2 * | 3/2010 | Shimizu | B65H 5/38 | 399/397 |
| 2005/0047842 | A1 | 3/2005 | Nobe | | |
| 2014/0064815 | A1 * | 3/2014 | Takahata | G03G 15/65 | 399/397 |
| 2016/0161875 | A1 * | 6/2016 | Yamamoto | G03G 15/0216 | 399/405 |

FOREIGN PATENT DOCUMENTS

| | | | |
|---|---|---|---|
| JP | 2000-122436 | A | 4/2000 |
| JP | 2005-075606 | A | 3/2005 |
| JP | 2008-110843 | | 5/2008 |
| JP | 2013-170016 | A | 9/2013 |

* cited by examiner

IMAGE FORMING APPARATUS

INCORPORATION BY REFERENCE

This application is based on Japanese Patent Application Serial No. 2016-141673 filed in Japan Patent Office on Jul. 19, 2016, the contents of which are hereby incorporated by reference.

BACKGROUND

The present disclosure relates to an image forming apparatus capable of image formation on opposite sides of a sheet.

There has been known an image forming apparatus capable of image formation on opposite sides of a sheet. There has also been known an image forming apparatus having an electroconductive brush disposed in a first conveyance path for conveying therealong to form an image on a first one of opposite sides of a sheet. The electroconductive brush is designed to eliminate static electricity from the sheet. The electroconductive brush is disposed to be contactable with the sheet after being discharged from a second conveyance path joined with the first conveyance path.

SUMMARY

According to one aspect of the present disclosure, there is provided an image forming apparatus for forming images on opposite sides of a sheet. The image forming apparatus includes an image forming section, a conveyance guide, and a static eliminator.

The image forming section is configured to form the images on the sheet being conveyed along a first conveyance path. The conveyance guide is configured to define a second conveyance path. The second conveyance path is a conveyance path for conveying therealong the sheet being switched back thereto from the first conveyance path, the second conveyance path arranged at a position downstream of the image forming section in a conveyance direction of the sheet conveyed along the first conveyance path. The second conveyance path has an outlet area joined with the first conveyance path at a position upstream of the image forming section in the conveyance direction. The static eliminator is configured to eliminate static electricity from the sheet fed from the first conveyance path to the second conveyance path, wherein the static eliminator is disposed in the outlet area.

DETAILED DESCRIPTION

Figure 1:
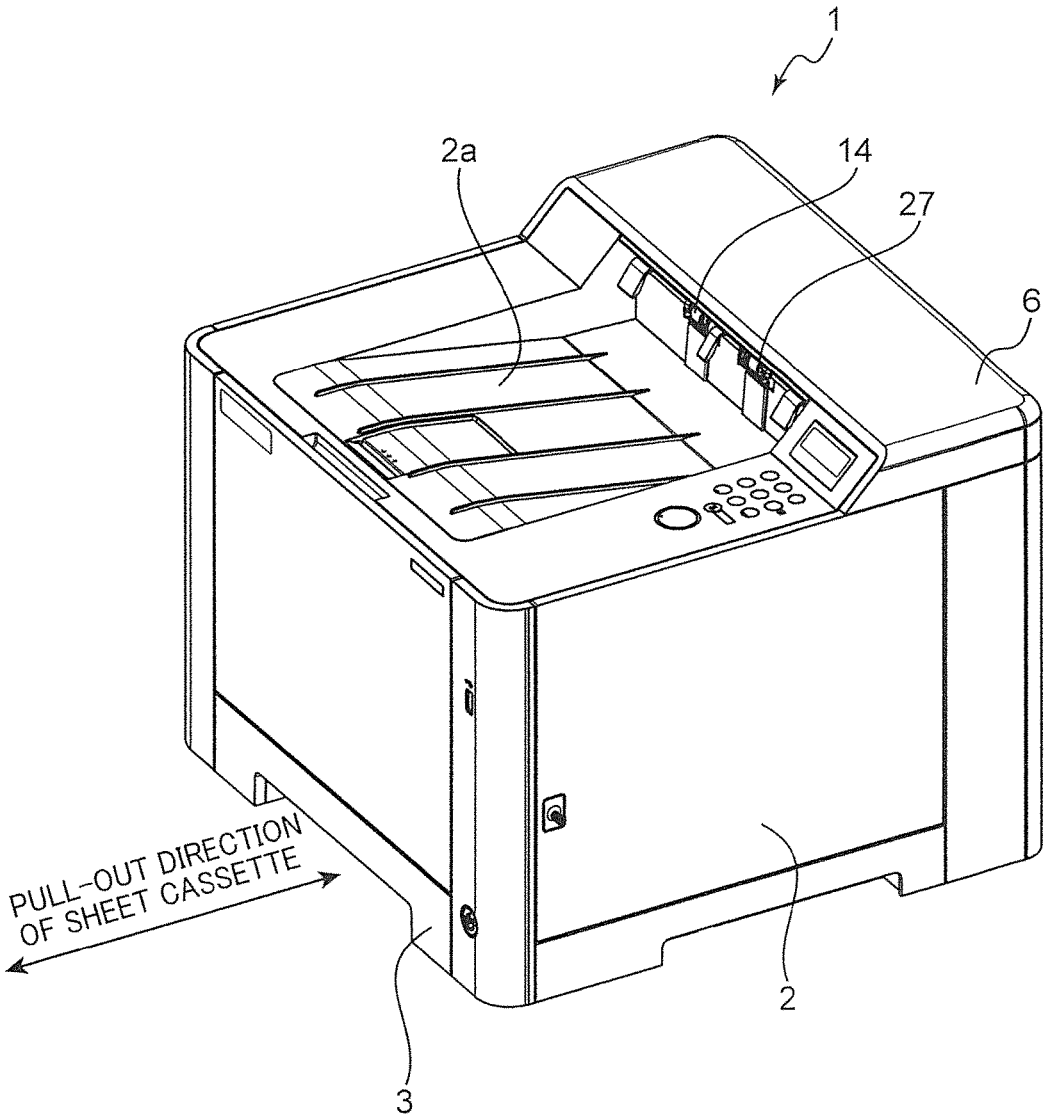
FIG. 1 is a perspective view depicting an image forming apparatus according to one embodiment of the present disclosure.
Figure 2:
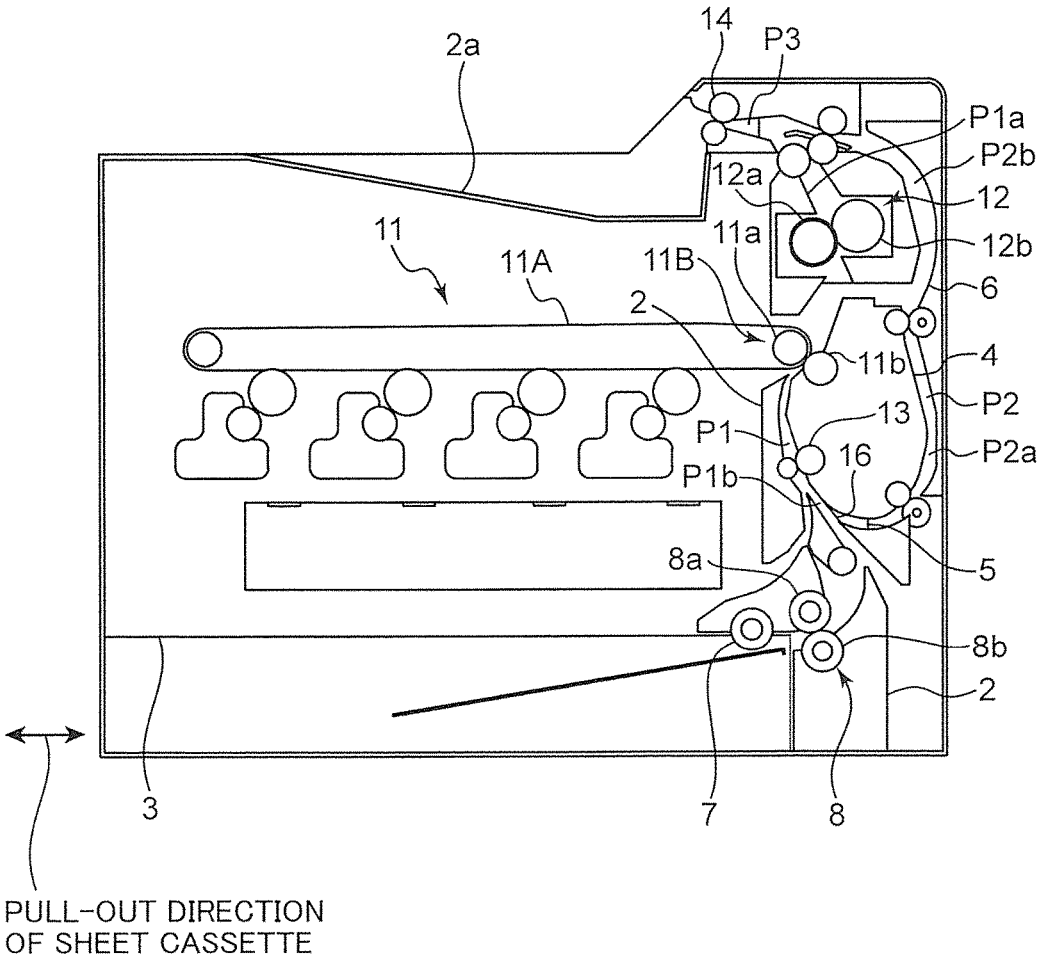
FIG. 2 is a schematic diagram depicting the image forming apparatus.
Figure 3:
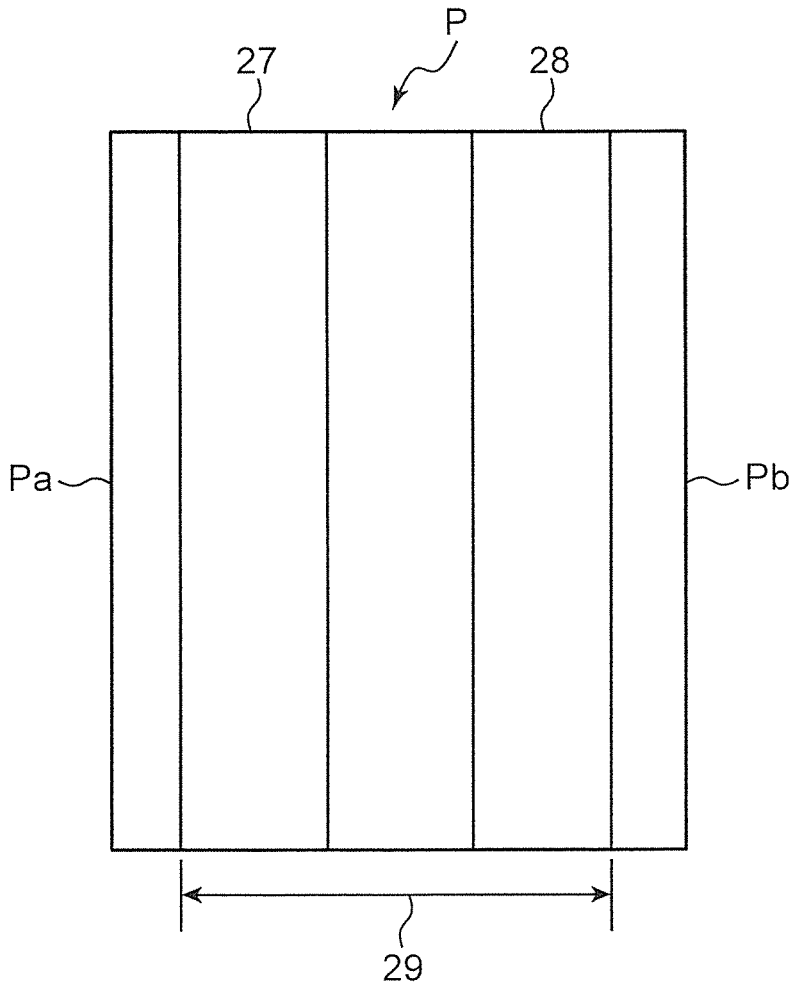
FIG. 3 is a top plan view depicting a sheet on which an image is to be formed by the image forming apparatus.

FIG. 1 is a perspective view depicting an image forming apparatus 1 according to one exemplary embodiment of the present disclosure. FIG. 2 is a schematic diagram depicting the exemplary image forming apparatus 1. FIG. 3 is a top plan view depicting a sheet P on which an image is to be formed by the exemplary image forming apparatus 1. The image forming apparatus 1 is a printer having a both-side printing function capable of printing images on opposite surfaces of the sheet P. This image forming apparatus 1 includes a cubic-shaped apparatus body 2 housing various devices or units, a sheet cassette 3 housing a bundle of the sheets P, a conveyance guide 4 configured to define a conveyance path for conveying the sheet P therealong, and a static eliminator 5 provided in the conveyance guide 4. The sheet P is composed, for example, a quite commonly-used A4-size sheet, and has a first edge Pa extending in a conveyance direction of the sheet P, and a second edge Pb extending in a conveyance direction of the sheet P, in opposed (parallel) relation to the first edge Pa. It should be understood that the sheet P is not limited to an A4-size sheet, but it is possible to use a sheet having any other suitable size, as long as the sheet is capable of being conveyed along aftermentioned conveyance paths.

The apparatus body 2 has an upper portion provided with a catch tray 2*a*. The catch tray 2*a* is configured to catch the sheet P on which an image has been formed. The apparatus body 2 includes: a first conveyance path P1 for conveying therealong the sheet P fed from the sheet cassette 3; a second conveyance path P2 for reversely conveying therealong the sheet P after only a first side thereof is subjected to printing (one-side printed sheet P) during a process of forming images on the opposite surfaces of the sheet P; and an ejection conveyance path P3 which connects the catch tray 2*a* with a downstream region P1*a* located on the side of a downstream end of the first conveyance path P1 in the sheet conveyance direction.

The sheet cassette 3 is attached to a lower portion of the apparatus body 2. The sheet cassette 3 is detachable from the apparatus body 2. The sheet cassette 3 is configured to be pulled out from a front side of the apparatus body 2 so as to enable new sheets to be manually supplied thereto (a pull-out direction of the sheet cassette 3 is indicated in FIGS. 1 and 2). In a region on an upper right side of the sheet cassette 3, there are provided a pickup roller 7 for picking up an uppermost one of the bundle of sheets P on a one-by-one basis, and a sheet-feeding roller pair 8 for feeding out the sheet P to an upstream end of the first conveyance path P1 in the sheet conveyance direction. The sheet-feeding roller pair 8 is composed of a feed roller 8*a*, and a retard roller 8*b* for conveying the sheets P one-by-one in cooperation with the feed roller 8*a*, while separating one sheet from the next.

Figure 4:
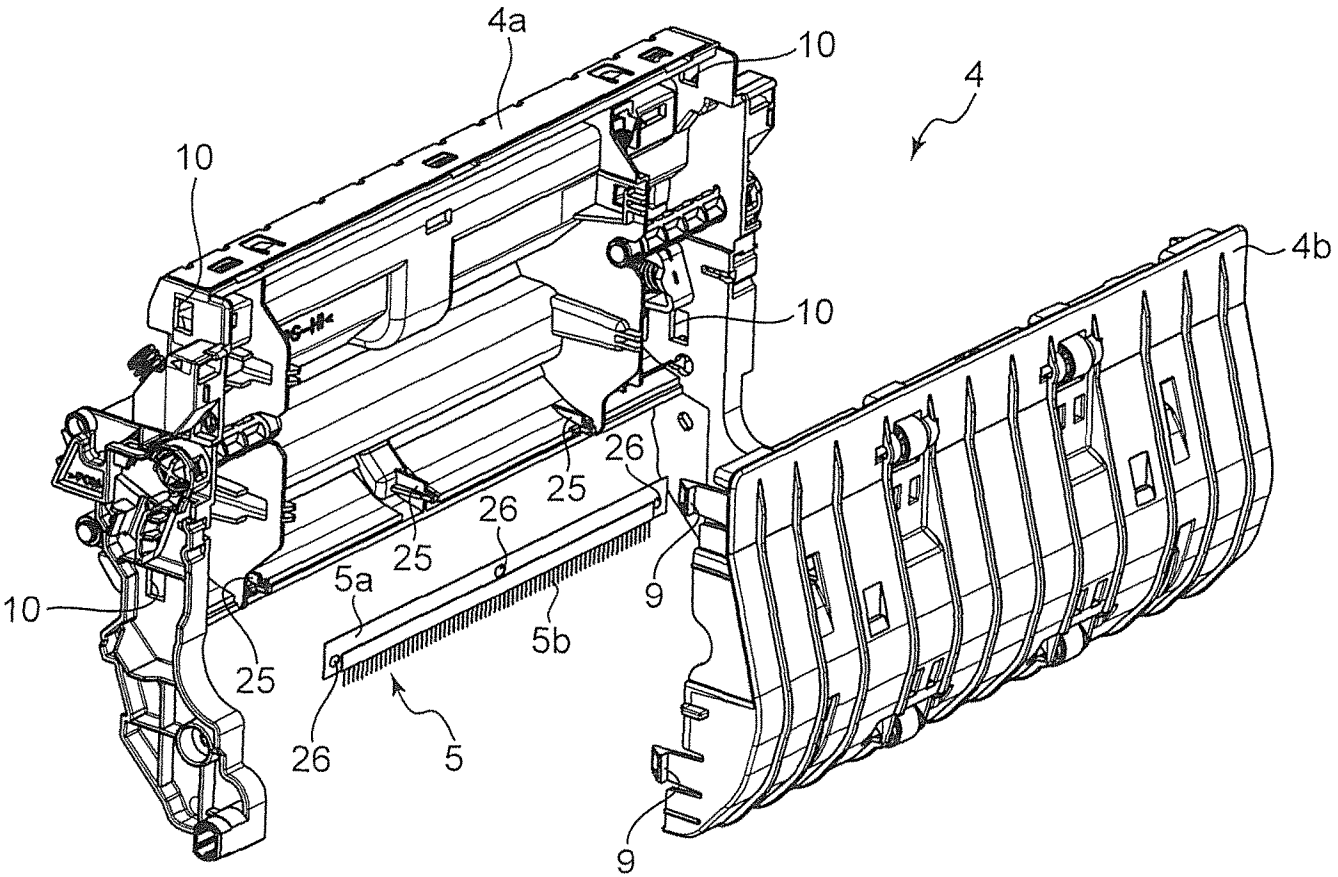
FIG. 4 is an exploded perspective view depicting a conveyance guide of the image forming apparatus.

FIG. 4 is an exploded perspective view depicting an exemplary conveyance guide. The conveyance guide 4 is attached to the apparatus body 2 swingably about a lower end thereof serving as a pivot point. The conveyance guide 4 is detachable from the apparatus body 2. During jam handling, an operator can open an access cover 6 as one sidewall of the apparatus body 2 to expose the second conveyance path P2, and can further swingably move the conveyance guide 4 to expose the first conveyance path P1. The conveyance guide 4 includes an approximately rectangular-shaped first guide member 4*a*, and an approximately rectangular-shaped second guide member 4*b*.

The first guide member 4*a* is configured such that, in cooperation with the apparatus body 2, it defines therebetween an upstream region P1*b* of the first conveyance path P1 in the sheet conveyance direction. Further, the second guide member 4*b* is configured to define a downstream region P2*a* of the second conveyance path P2 in the sheet conveyance direction, in cooperation with the access cover 6 disposed in opposed relation thereto (see FIG. 2). The conveyance 4 is assembled by bringing four engagement pawls 9 formed, respectively, at four corners of an inner wall of the second guide member 4*b*, into engagement with four cutouts 10 formed in lateral walls of the first guide member 4*a*, respectively.

Referring to FIG. 2, the first conveyance path P1 extends in an upward-downward direction from a vicinity of a bottom wall to a vicinity of a top wall of the apparatus body 2, wherein the upstream region P1*b* communicates with the downstream region P1*a*. The ejection conveyance path P3 communicates with the downstream region P1*a* of the first conveyance path P1. The ejection conveyance path P3 has a downstream end formed as an ejection/reverse port 27 (see FIG. 1) opening toward the catch tray 2*a*.

At an approximately intermediate position of the first conveyance path P1 in the sheet conveyance direction, an image forming section 11 is disposed. The image forming section 11 is configured to form images on the sheet P. The image forming section 11 includes: four-color CMYBk image forming units each including a photosensitive drum having an outer peripheral surface on which a toner image is to be formed, an electrostatic charger, a developer and an exposure device; an intermediate transfer unit including a transfer belt 11A onto which four-color toner images are primarily transferred from the respective photosensitive drums in a superimposed manner; and a secondary transfer unit 11B for secondarily transferring a full-color toner image from the transfer belt 11A to the sheet P.

The secondary transfer unit 11B includes an opposing roller 11*a* which is rotatably supported by the apparatus body 2 and around which the transfer belt 11A is wound, and a transfer roller 11*b* rotatably supported by the conveyance guide 4. The opposing roller 11*a* and the transfer roller 11*b* are disposed in opposed relation, while interposing the first conveyance path P1 therebetween, and clamping the transfer belt 11A therebetween to form a transfer nip zone. The transfer roller 11*b* is operable to transfer the full-color toner image on the transfer belt 11A, to the sheet P.

In the first conveyance path P1 at a position downstream of the image forming section 11 (secondary transfer unit 11B) in the sheet conveyance direction, a fixing unit 12 is disposed. The fixing unit 12 includes a fixing roller 12*a* incorporating a heat source, and a pressure roller 12*b* for forming a fixing nip zone in the first conveyance path P1, in cooperation with the fixing roller 12*a*. Both of the fixing roller 12*a* and the pressure roller 12*b* are provided on the apparatus body 2. The fixing unit 12 is operable to heat and press the sheet P having the toner image transferred thereonto through the fixing nip zone to thereby subject the sheet P to fixing.

In the first conveyance path P1 at a position upstream of the image forming section 11 (secondary transfer unit 11B) in the sheet conveyance direction, a registration roller pair 13 is disposed. The registration roller pair 13 is operable to feed out the sheet P to the transfer nip zone at a given timing. At the downstream end of the ejection conveyance path P3, an ejection/reverse roller pair 14 is disposed. The ejection/reverse roller pair 14 is operable to eject the sheet P having the image(s) formed thereon, to the catch tray 2*a*.

Figure 5:
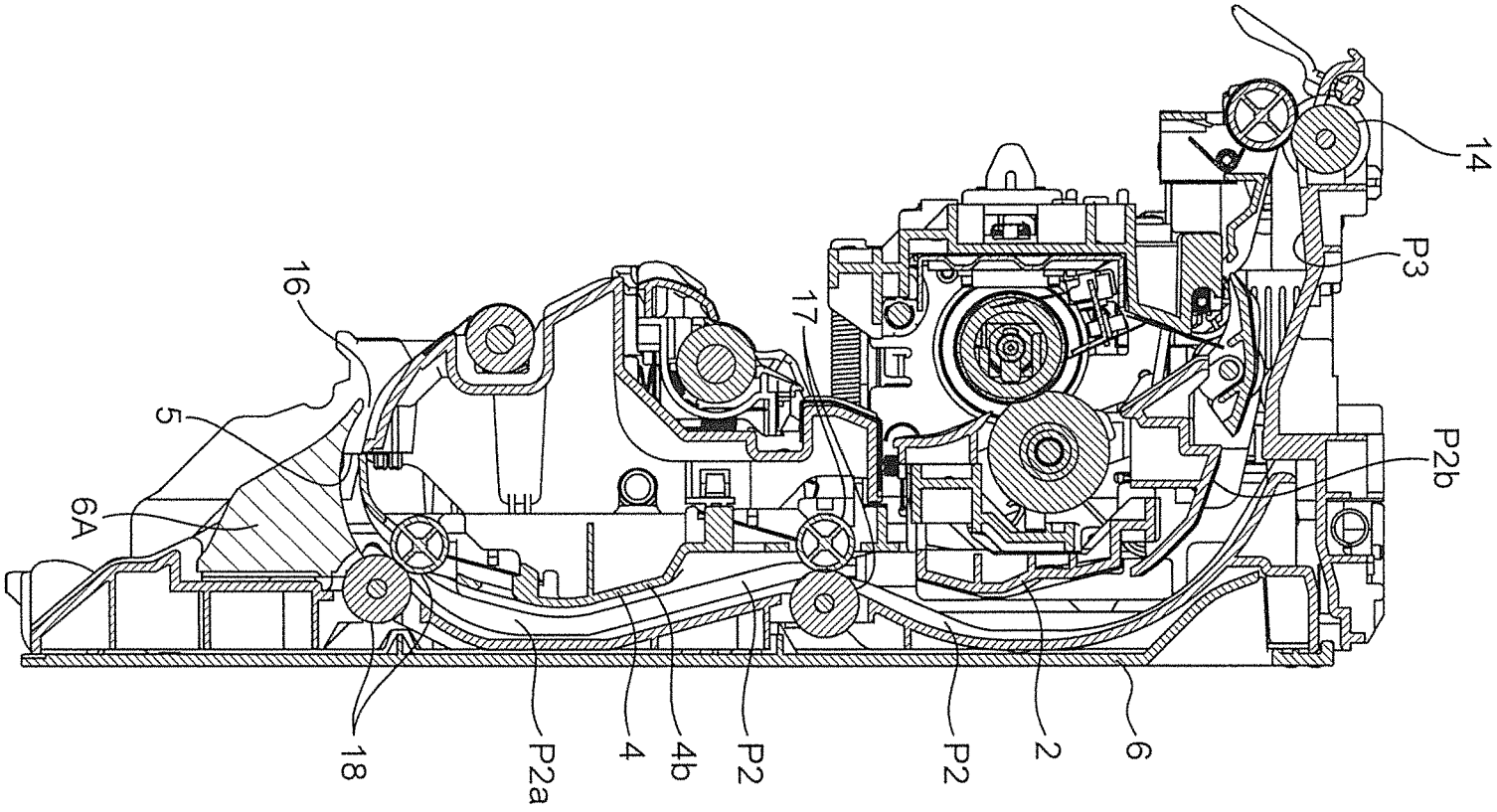
FIG. 5 is a vertical sectional view depicting an access cover of the image forming apparatus.
Figure 6:
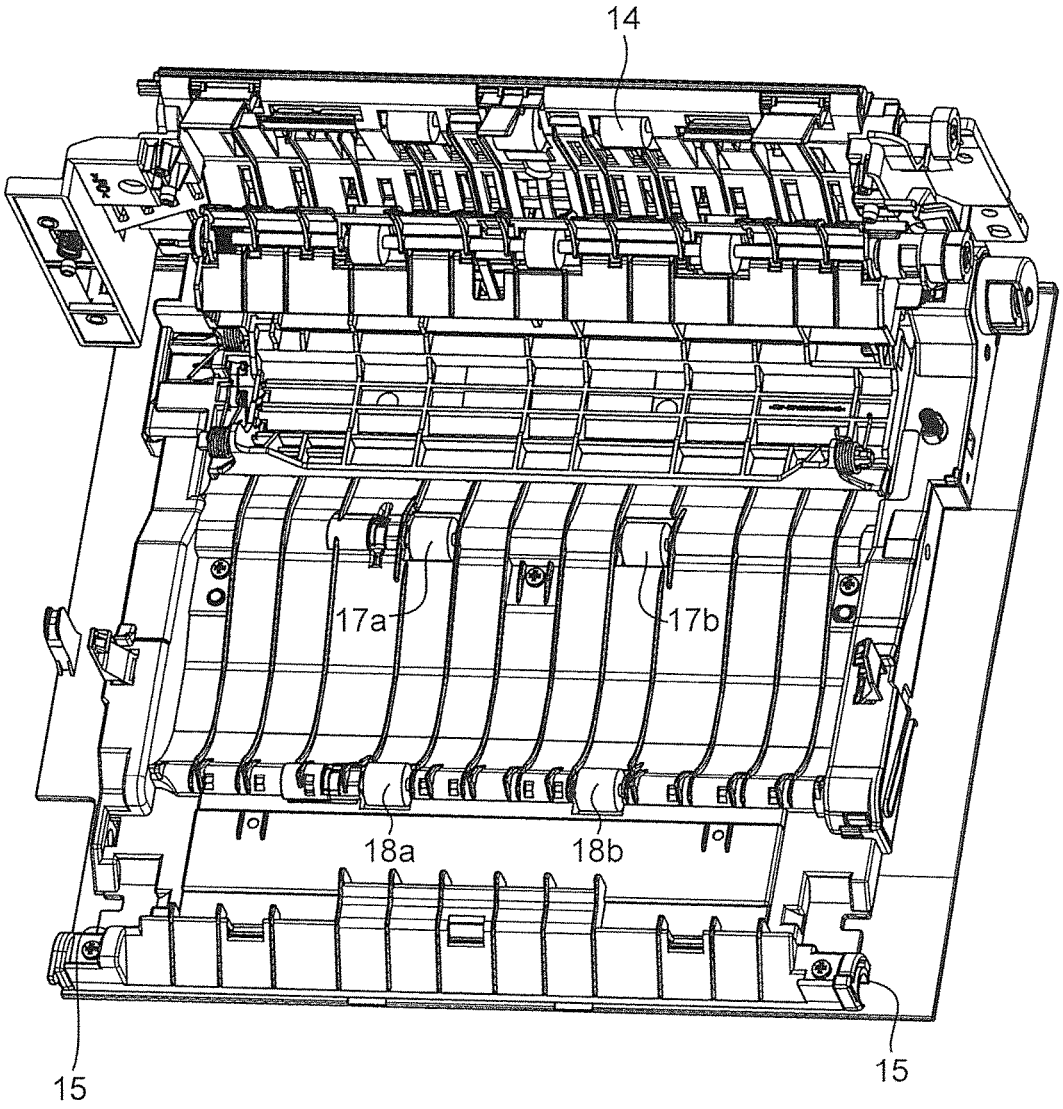
FIG. 6 is a perspective view depicting the access cover of the image forming apparatus.

FIG. 5 is a vertical sectional view depicting the access cover 6 of the exemplary image forming apparatus 1, and FIG. 6 is a perspective view depicting the access cover 6. The access cover 6 makes up one of four sidewalls of the apparatus body 2. The access cover 6 is disposed to cover the conveyance guide 4 to define the second conveyance path P2 in cooperation with the conveyance guide 4. The access cover 6 is configured to be opened so as to expose the second conveyance path P2. An inner wall of the access cover 6 serves as a third guide member for defining the second conveyance path P2 in cooperation with the second guide member 4*b* of the conveyance guide 4 disposed in opposed relation thereto.

The access cover 6 has a pivot point portion 15 at lower end thereof, so that an upper portion thereof can be swingably moved about the pivot point portion 15 to cause the ejection conveyance path P3 and an upstream region P2*b* of the second conveyance path P2 to be exposed. Therefore, in a situation where the sheet P is jammed in the ejection conveyance path P3 or the upstream region P2*b* of the second conveyance path P2, a user can easily take out the sheet P by opening the upper portion of the access cover 6.

The second conveyance path P2 is defined between the conveyance guide 4 and the access cover 6. The second conveyance path P2 has a branch area which branches off from the first conveyance path P1 at a position downstream of the fixing unit 12 in the sheet conveyance direction. This branch area is an upstream end of the second conveyance path P2. Further, the second conveyance path P2 has an outlet area 16 which is joined with the first conveyance path P1 at a position upstream of the image forming section 11 in the sheet conveyance direction. This outlet area 16 is a downstream end of the second conveyance path P2. A lower guide surface around the downstream end of the second conveyance path P2 is formed by a guide member 6A installed in the apparatus body 2.

Figure 7:
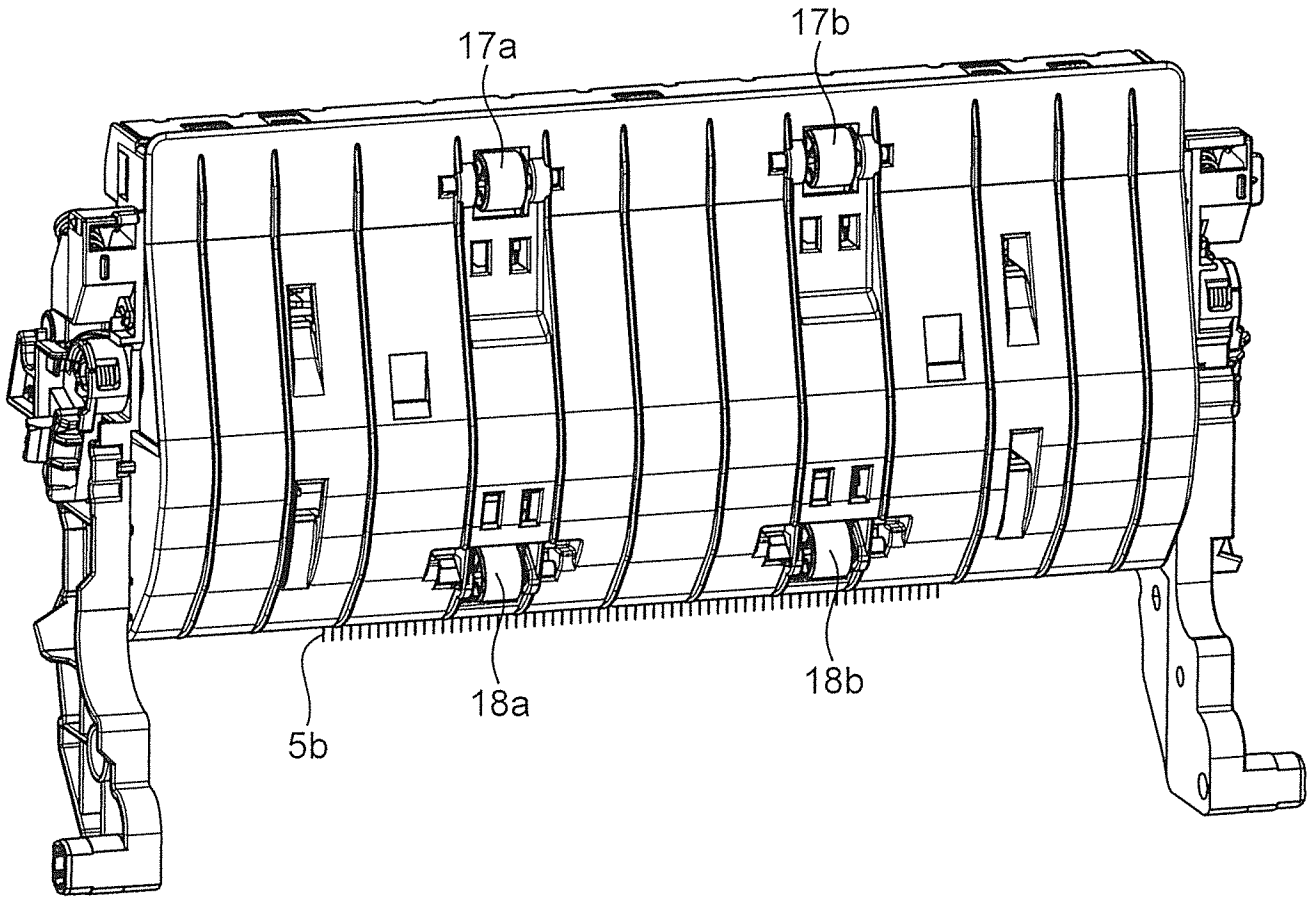
FIG. 7 is a perspective view depicting the conveyance guide with a static eliminator attached thereto.

FIG. 7 is a perspective view depicting an exemplary conveyance guide 4 for definition the second conveyance path P2. In a region where an upper portion of an outer wall of the second guide member 4*b* of the conveyance guide 4 is opposed to the access cover 6, a plurality of first conveyance roller pairs 17 are provided. Each of the plurality of first conveyance roller pairs 17 is configured to be contactable with the sheet P in the second conveyance path P2, and rotatable to thereby convey the sheet P. The plurality of first conveyance roller pairs 17 are arranged in an approximately intermediate region of the second conveyance path P2 in the sheet conveyance direction. The plurality of first conveyance roller pairs 17 are arranged in spaced-apart relation to each other in a direction orthogonal to the conveyance direction of the sheet P, i.e., in a width direction of the second conveyance path P2.

In FIGS. 6 and 7, among the plurality of first conveyance roller pairs 17, a leftmost first conveyance roller pair 17*a* is disposed to come into contact with the sheet P at a position closest to the first edge Pa of the sheet P. On the other hand, a rightmost first conveyance roller pair 17*b* is disposed to come into contact with the sheet P at a position closest to the second edge Pb of the sheet P. In this embodiment, the number of the first conveyance rollers pairs 17 rotatable along with the movement of the sheet P is two. Alternatively, the number may be three or more.

In a region where a lower portion of the outer wall of the second guide member 4*b* of the conveyance guide 4 is opposed to the access cover 6, a plurality of second conveyance roller pairs 18 are provided. Each of the plurality of second conveyance roller pairs 18 is configured to be contactable with the sheet P in the second conveyance path P2, and rotatable to thereby convey the sheet P. The plurality of second conveyance roller pairs 18 are arranged in the downstream region P2*a* of the second conveyance path P2 in the sheet conveyance direction. The plurality of second conveyance roller pairs 18 are arranged in spaced-apart relation to each other in the direction orthogonal to the conveyance direction of the sheet P, i.e., in the width direction of the second conveyance path P2.

In FIGS. 6 and 7, among the plurality of second conveyance roller pairs 17, a leftmost second conveyance roller pair 18*a* is disposed to come into contact with the sheet P at a position closest to the first edge Pa of the sheet P. On the other hand, a rightmost second conveyance roller pair 18*b* is disposed to come into contact with the sheet P at a position closest to the second edge Pb of the sheet P. In this embodiment, the number of the second conveyance rollers pairs 18 rotatable along with the movement of the sheet P is two. Alternatively, the number may be three or more.

As depicted in FIG. 4, three bosses 25 each protruding toward the second guide member 4*b* are provided on a lower portion of an inner wall of the first guide member 4*a*, at even intervals in the width direction. Correspondingly, three engagement holes (not depicted) into each of which a corresponding one of the bosses 25 is to be fittingly inserted are formed in a lower portion of an inner wall of the second guide member 4*b*, at even intervals in the width direction. The first guide member 4*a* and the second guide member 4*b* are integrated together by fittingly inserting each of the bosses 25 into a corresponding one of the engagement holes. Alternatively, the bosses 25 may be formed on the second guide member 4*b*, and the engagement holes into each of which a corresponding one of the bosses 25 is to be fittingly inserted may be formed in the first guide member 4*a*.

The static eliminator 5 includes an approximately rectangular-shaped attaching plate 5*a* formed with three through-holes 26 through each of which a corresponding one of the bosses 25 is to be inserted, and an electroconductive brush 5*b* mounted to the attaching plate 5*a*. The electroconductive brush 5*b* is formed and mounted to extend in a longitudinal direction of the attaching plate 5*a* over a distance between one end to the other end of the attaching plate 5*a*. Thus, the static eliminator 5 is contactable with a first region 27 of the sheet P with which the conveyance roller pair 17*a* and the conveyance roller pair 18*a* have contacted, and a second region 28 of the sheet P with which the conveyance roller pair 17*b* and the conveyance roller pair 18*b* have contacted, over an overall length 29 connecting the first and second regions 27, 28 together in the width direction of the second conveyance path P2 (see FIG. 3). That is, the static eliminator 5 is contactable with the first and second regions 27, 28 of the sheet P with which conveyance roller pairs 17*a*, 17*b* arranged at both ends in the width direction have contacted respectively and an intermediate region between the first and second regions. Therefore, static charges arising on the sheet P due to contact between the sheet P and the first and second conveyance rollers pairs 17, 18 are sufficiently eliminated.

Instead of the plurality of first conveyance rollers pairs 17 and the plurality of second conveyance rollers pairs 17, 18, a single conveyance rollers pair which is relatively long in the width direction may be used. In this case, the static eliminator 5 is configured to be contactable with a specific region of the sheet P with which the long conveyance roller pair has contacted, over an overall length of the specific region extending in the width direction.

The static eliminator 5 is provided in the conveyance guide 4. Specifically, the static eliminator 5 is attached to the conveyance guide 4 by inserting each of the three bosses 25 of the first guide member 4*a* through a corresponding one of the three through-holes of the attaching plates 5*a*, and assembling the first guide member 4*a* and the second guide member 4*b* together. In this way, the static eliminator 5 is disposed in the outlet area of the second conveyance path P2, wherein the electroconductive brush 5*b* protrudes into the second conveyance path P2 and comes into contact with the sheet P as the sheet P is conveyed along the second conveyance path P2. Therefore, the static eliminator 5 can eliminate, in the second conveyance path P2, static electricity from the sheet P being conveyed along the second conveyance path P2. The electroconductive brush 5*b* is contactable with an image-formed side (first side) of a one-side printed sheet P. As used in this specification, the term "disposed in the outlet area" means being disposed in and in the vicinity of the outlet area 16. More specifically, the static eliminator 5 may be disposed at a position close to or slightly upstream of the outlet area (provided, however, that it should be disposed downstream of the conveyance roller pairs 18).

The static eliminator 5 may be connected to a ground (earth) wire provided in the image forming apparatus 1 to form a grounding line for the image forming apparatus 1, or may not be connected to the ground wire. This is because, even when the static eliminator 5 is not connected to the ground wire, static charges are air-discharged from the electroconductive brush 5*b* of the static eliminator 5, so that static charges accumulated in the static eliminator 5 can be easily dispersed via the electroconductive brush 5*b*. In the above embodiment, the static eliminator 5 is attached to the conveyance guide 4. Alternatively, the static eliminator 5 may be attached to the guide member 6A.

The image forming apparatus 1 according to this disclosure configured as above operates as follows. First of all, an uppermost one of the bundle of sheets P housed in the sheet cassette 3 is picked up by the pickup roller 7 on a one-by-one basis. The picked-up sheet P is fed out to the upstream end of the first conveyance path P1 via the sheet-feeding roller pair 8.

The sheet P fed out to the upstream end of the first conveyance path P1 is fed out to the secondary transfer unit 11B at a given timing via the registration roller pair 13. A full-color toner image on the transfer belt 11A is transferred to a first side of the sheet P passing through the position of the secondary transfer unit 11B in the first conveyance path P1, by the transfer roller 11*b*.

The sheet P having the toner image transferred to the first side thereof is conveyed to the fixing unit 12. Then, the sheet P is heated and pressed through the fixing nip zone of the fixing unit 12 to thereby subject the first side of the sheet P to fixing. The sheet P subjected to the fixing is fed out to the catch tray 2*a* via the ejection/reverse roller pair 14. In this manner, an image is formed on the first side of the sheet P.

On the other hand, in case of forming images on opposite sides of the sheet P, after the first side of the sheet P is subjected to the fixing, the sheet P is partly ejected to the catch tray 2*a* via the ejection/reverse roller pair 14. In this state, the sheet P is stopped once. Subsequently, the ejection/reverse roller pair 14 is reversely rotated, so that the sheet P is switched back and conveyed from the first conveyance path P1 to the second conveyance path P2.

The sheet P fed to the second conveyance path P2 is conveyed to the downstream region of the second conveyance path P2 via the first conveyance rollers pairs 17 each including an upper driven roller and an upper driving roller, and further conveyed to the vicinity of the outlet area of the second conveyance path P2 via the second conveyance rollers pairs 18 each including a lower driven roller and a lower driving roller.

In this process, the sheet P conveyed along the second conveyance path P2 is likely to be statically charged due to contact with the first and second conveyance roller pairs 17, 18 and the walls defining the second conveyance path P2. However, when the statically charged sheet P is conveyed around the outlet area of the second conveyance path P2, the sheet P is brought into contact with the electroconductive brush 5*b* of the static eliminator 5, so that static charges on the sheet P are eliminated. Then, the sheet P is fed from the second conveyance path P2 to the first conveyance path P1.

The sheet P fed to the first conveyance path P1 from the second conveyance path P2 is fed out to the secondary transfer unit 11B at a given timing via the registration roller pair 13, and then a toner image on the transfer belt 11A is transferred to a second side of the sheet P by the transfer roller 11*b*.

The sheet P having the toner image transferred to the second side thereof is conveyed to the fixing unit 12. Then, the sheet P is heated and pressed through the fixing nip zone of the fixing unit 12 to thereby subject the second side to fixing. The sheet P subjected to the fixing is fed out to the catch tray 2*a* via the ejection/reverse roller pair 14. In this manner, an image is formed on the second side of the sheet P.

The static eliminator 5 is provided in the vicinity of the output area 16 of the second conveyance path P2 located at a position upstream of and relatively close to the image forming section 11 (secondary transfer unit 11B). Thus, even when the sheet P being conveyed along the second conveyance path P2 is statically charged, static electricity on the sheet P is sufficiently eliminated by the static eliminator 5. This makes it possible to introduce the sheet P to the secondary transfer unit 11B while maintaining a static elimination effect. Therefore, in the above image forming apparatus 1, during both-side printing, it becomes possible to normally transfer toner to the sheet P to stably obtain high image quality.

The static eliminator 5 includes the electroconductive brush 5*b* contactable with the sheet P being conveyed, so that static charges accumulated in the static eliminator 5 are more likely to be air-discharged via the electroconductive brush 5*b*. Thus, in the above image forming apparatus 1, it becomes possible to easily disperse static charges accumulated in the static eliminator 5.

The static eliminator 5 is provided in the conveyance guide 4, so that it is more likely to come into contact with the sheet P being conveyed along the second conveyance path P2. This makes it easier to eliminate static charges arising on the sheet P due to contact between the sheet P and the walls defining the second conveyance path P2.

In the above image forming apparatus 1, the electroconductive brush 5*b* is not connected to the ground wire, so that a metal wire connecting the electroconductive brush 5*b* and the ground wire is omitted. Thus, the above image forming apparatus 1 can be reduced in terms of component cost.

In the above image forming apparatus 1, the static eliminator 5 is attached to the conveyance guide 4 simply by inserting each of the bosses 25 through a corresponding one of the through-holes 26 of the attaching plates 5*a* of the static eliminator 5, and clamping the attaching plate 5*a* of the static eliminator 5 between the first and second guide members 4*a*, 4*b*. Thus, in the above image forming apparatus 1, it becomes possible to facilitate operation of attaching the static eliminator 5 to the conveyance guide 4.

As mentioned above, in the image forming apparatus 1 according to the present disclosure includes the static eliminator 5 for subjecting the sheet P fed from the first conveyance path P1 to the second conveyance path P2, to static elimination in the vicinity of the outlet area of the second conveyance path P2. Thus, it becomes possible to sufficiently eliminate static electricity on the one-side printed sheet P before the sheet P is introduced from the second conveyance path P2 to the first conveyance path P1, during both-side printing, to thereby enable good images to be formed on opposite sides of the sheet P.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus for forming images on opposite sides of a sheet, comprising:

an image forming section that forms the images on the sheet being conveyed along a first conveyance path;

a conveyance guide that defines a second conveyance path which conveys therealong the sheet being switched back thereto from the first conveyance path, the second conveyance path arranged at a position downstream of the image forming section in a conveyance direction of the sheet conveyed along the first conveyance path and having an outlet area joined with the first conveyance path at a position upstream of the image forming section in the conveyance direction; and a static eliminator that eliminates static electricity from the sheet fed from the first conveyance path to the second conveyance path, the static eliminator being disposed in the outlet area and including an electroconductive brush contactable with the sheet, wherein:

the conveyance guide includes a first guide member that defines the first conveyance path, and a second guide member that defines the second conveyance path, wherein one of the first and second guide members has a boss engageable with another one of the first and second guide members, whereby the first and second guide members are fittingly integrated together by using the boss; and the static eliminator includes an attaching plate through which the electroconductive brush is supported and that is formed with a through-hole through which the boss is inserted, wherein the attaching plate is clamped between the first and second guide members, and the electroconductive brush protrudes from a qap in a fitting section between the first and second guide members, into the outlet area of the second conveyance path.

2. The image forming apparatus according to claim 1, wherein the static eliminator is provided in the conveyance guide.

3. The image forming apparatus according to claim 1, which further comprises a conveyance roller pair which is contactable with the sheet in the second conveyance path and rotatable to thereby convey the sheet, wherein the static eliminator is contactable with a specific region of the sheet with which the conveyance roller pair has contacted, over an overall length of the specific region extending in a width direction orthogonal to the conveyance direction.

4. The image forming apparatus according to claim 1, which further comprises a plurality of conveyance roller pairs each of which is contactable with the sheet in the second conveyance path and rotatable to thereby convey the sheet, the plurality of conveyance roller pairs being arranged in a width direction orthogonal to the conveyance direction, wherein the static eliminator is contactable with first and second regions of the sheet with which conveyance roller pairs of the plurality of the conveyance roller pairs arranged at both ends in the width direction have contacted respectively and an intermediate region between the first and second regions.

5. The image forming apparatus according to claim 1, wherein the static eliminator is not grounded.

6. An image forming apparatus for forming images on opposite sides of a sheet, comprising:

an image forming section that forms the images on the sheet being conveyed along a first conveyance path;

a conveyance guide that defines a second conveyance path that conveys therealong the sheet being switched back thereto from the first conveyance path, the second conveyance path being arranged at a position downstream of the image forming section in a conveyance direction of the sheet conveyed along the first conveyance path and having an outlet area joined with the first conveyance path at a position upstream of the image forming section in the conveyance direction; and a static eliminator that eliminates static electricity from the sheet fed from the first conveyance path to the second conveyance path, the static eliminator being disposed in the outlet area and including an electroconductive brush contactable with the sheet, wherein the electroconductive brush is contactable, in the outlet area, with a face of the sheet having the image formed thereon.

7. The image forming apparatus according to claim 6, wherein the static eliminator is provided in the conveyance guide.

8. The image forming apparatus according to claim 6, further comprising a conveyance roller pair that is contactable with the sheet in the second conveyance path and rotatable to thereby convey the sheet, wherein the static eliminator is contactable with a specific region of the sheet with which the conveyance roller pair has contacted, over an overall length of the specific region extending in a width direction orthogonal to the conveyance direction.

9. The image forming apparatus according to claim 6, further comprising a plurality of conveyance roller pairs each of which is contactable with the sheet in the second conveyance path and rotatable to thereby convey the sheet, the plurality of conveyance roller pairs being arranged in a width direction orthogonal to the conveyance direction, wherein the static eliminator is contactable with first and second regions of the sheet with which conveyance roller pairs of the plurality of the conveyance roller pairs arranged at both ends in the width direction have contacted respectively and an intermediate region between the first and second regions.

10. The image forming apparatus according to claim 5, wherein the static eliminator is not grounded.

11. An image forming apparatus for forming images on opposite sides of a sheet, comprising:

an image forming section that forms the images on the sheet being conveyed along a first conveyance path;

a conveyance guide that defines a second conveyance path that conveys therealong the sheet being switched back thereto from the first conveyance path, the second conveyance path being arranged at a position downstream of the image forming section in a conveyance direction of the sheet conveyed along the first conveyance path and having an outlet area joined with the first conveyance path at a position upstream of the image forming section in the conveyance direction, the conveyance guide including a guide member that constitutes a guide surface around a downstream end of the second conveyance path near the outlet area; and a static eliminator that eliminates static electricity from the sheet fed from the first conveyance path to the second conveyance path, the static eliminator being disposed to protrude into the second conveyance path at a position where the guide member is arranged.

* * * * *